United States Patent [19]

Nakano et al.

[11] Patent Number: 4,473,313

[45] Date of Patent: Sep. 25, 1984

[54] TIMING CONTROL METHOD FOR CONTROLLING RECIPROCATING PRINT HEAD

[75] Inventors: Hiroshige Nakano; Atsuhiko Takanashi, both of Ibaragi, Japan

[73] Assignee: Hitachi Koki Co., Ltd., Tokyo, Japan

[21] Appl. No.: 378,354

[22] Filed: May 14, 1982

[30] Foreign Application Priority Data

May 15, 1981 [JP] Japan ..... 56-73826

[51] Int. Cl.[3] ..... B41J 3/12

[52] U.S. Cl. ..... 400/322; 101/93.04; 400/121

[58] Field of Search ..... 400/124, 121, 320, 322, 400/323; 101/93.04, 93.05

[56] References Cited

U.S. PATENT DOCUMENTS 4,116,567 9/1978 San Pietro ..... 400/124

4,284,362 8/1981 Jackson et al. ..... 400/323 X

*Primary Examiner*—Paul T. Sewell

*Attorney, Agent, or Firm*—Sughrue, Mion, Zinn, Macpeak & Seas

[57] ABSTRACT

A timing control device for use with a printer or the like contains a memory device storing detection signals at sequential memory locations, the number of which may be varied by adjusting the peroid of a clear signal applied to an address counter. The detection signals sequentially stored in the memory are successively read out after one period of the clear signal has elapsed, whereby a variable delay function is achieved.

6 Claims, 6 Drawing Figures

TIMING CONTROL METHOD FOR CONTROLLING RECIPROCATING PRINT HEAD

BACKGROUND OF THE INVENTION

This invention relates to a timing control device in which the position of a moving body which runs at a given speed is detected, and according to the detection signal, a signal for starting an operation with a predetermined delay time is produced.

More specifically, the invention relates to a timing control device in which the position of a moving body such as a print band or a print hammer of a printer, which runs at a given speed, is detected, so that the print hammer is driven at the exact time instant whereby characters are printed correctly.

A printer will be described, by way of example, in which a plurality of print hammers 1 having dot elements are arranged in parallel with the print line, and a hammer bank 2 supporting these print hammers 1 is reciprocated across the printing paper, so that during reciprocation the print hammers 1 are selectively operated to print dots at selected positions (FIG. 1).

The printer has thirty-four print hammers 1, each of which is reciprocated over a distance corresponding to four characters. A cam device is employed to reciprocate the hammer bank 2. An encoder disc 5 for detecting the positions of the print hammers 1 and a pulley 6 for transmitting the power of a motor 9 are mounted on the cam shaft 4 of the cam device 3.

As the motor 9 rotates, the pulley 6 is turned through a pulley mounted on the output shaft of the motor 9 and a timing belt 7, so that the hammer bank 2 is reciprocated by means of the cam device 3. The locus of motion of the hammer bank 2 is as shown in FIG. 2.

Slits 10 are formed in the encoder disc 5 in correspondence to print positions on the locus of motion in FIG. 2. A detector 12 is provided to detect the slits 10. More specifically, when the detector 12 detects a slit 10, it outputs a logical value "1"; and when the detector 12 detects no slit 10, it outputs a logical value "0".

In order to detect the direction of reciprocation of the hammer bank 2, an additional slit 11 distinct from the aforementioned slits 10 is formed in the encoder disc 5. The slit 11 is detected by detectors 13 and 14. More specifically, the hammer bank 2 is moved from left to right for the time interval which elapses from the instant when the detector 13 detects the slit 11 to provide a logical value "1" until the detector 14 detects the slit 11 to output a logical value "1". On the other hand, the hammer bank 2 is moved from right to left for the time interval which elapses from the instant the detector 14 detects the slit 11 to output a logical value "1" until the detector 14 detects the slit 11 to provide the logical value "1".

In order to print dots at the print positions on the locus of motion shown in FIG. 2, the time instant when the slit 10 corresponding to each print position is detected by the detector 12 should be advanced by the flight time $T_f$ which elapses from the instant the print hammer 1 is driven until it strikes against the printing paper. This may be achieved by employing a method in which adjustment is accomplished by displacing the detector 12.

The locus of motion of the hammer bank 2 is defined by the cam device 3; however, in positioning the cam and the encoder disc 5, it is difficult to position them accurately at the reference position; in other words an error of ±5 degrees, in general, takes place. Accordingly, the range of adjustment of the detector 12 is more than ±5 degrees with respect to the detector mounting reference position.

On the other hand, in the printer, four characters are printed by one hammer 1. One character is composed of tweleve dots. Accordingly, the hammer has 48 dot print positions in the lateral direction. When the cam of the cam device 3 makes one revolution, the hammer bank 2 accomplishes one reciprocation. That is, when the encoder disc 5 turns through 180 degrees, the hammer bank 2 accomplishes a one-way motion. During this period, dots must be printed at 48 dot print positions, and the printing paper must be advanced vertically to the next dot position. The time required for advancing the printing paper converts into an angle of rotation of about 50 degrees of the encoder disc 5. Thus, 48 slits 10 are distributed within an angle of about 130 degrees; that is, the slits 10 are provided at angular intervals of about 2.8 degrees. Accordingly, three of four slits 10 are provided within an adjustment range of ±5 degrees, i.e. in the range of 10 degrees.

As it is difficult to adjust the mechanism, a method of electrically varying the print hammer drive time has been employed in such a printer.

In this method, when the detector 12 detects the slit 10 in the encoder disc 5 and outputs the logical value "1", a monostable multivibrator is operated, and an output signal provided when the multivibrator is stopped is employed as the print hammer drive start time. The same effect as that which is obtained by adjusting the mechanism is obtained by varying the output time of the multivibrator.

The method may be employed in the case where the variable time width of the multivibrator is smaller than the value obtained by converting the angular interval of the slits 10 into time; however, it is not employable in the case where the former is larger than the latter, because the positional correspondence is shifted.

That is, the above method is not employable in the case where the range of adjustment is wide, as just described; that is, in the case where three of four slits 10 are included in the range of adjustment.

SUMMARY OF THE INVENTION

Accordingly, an object of this invention is to eliminate the above-described drawbacks of the prior art, to thereby facilitate adjustment.

In the invention, the detection signal of the slit 10 is written into a memory, and is read out after a predetermined period of time, so that adjustment can be readily achieved.

DETAILED DESCRIPTION OF THE PREFERRED EMBODIMENTS

Figure 1:
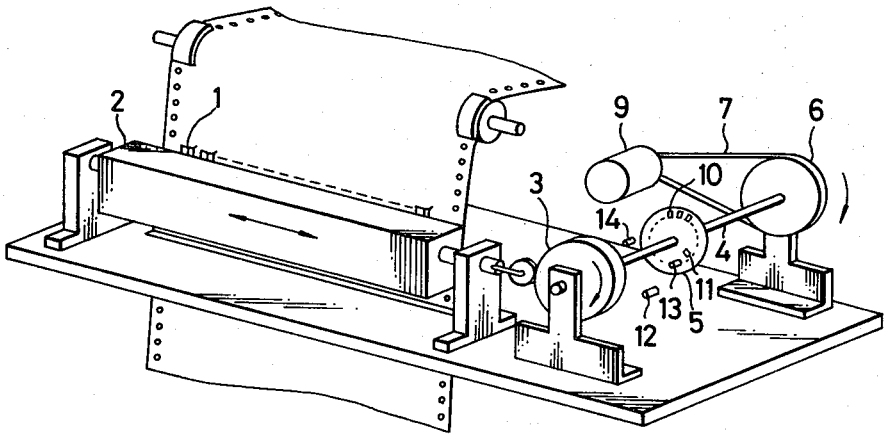
FIG. 1 is a perspective view outlining the arrangement of one example of a printer to which a timing control device according to the invention is applied.

One embodiment of this invention will now be described with reference to FIGS. 1 and 3–5.

When a voltage is applied to the motor 9, the pulley is turned via the belt 7. When the speed of the motor 9 becomes constant, the pulley 6 is turned at a constant speed, as is the encoder disc 5.

When the detectors 13 and 14 detect the slit 11, amplifier and waveform shaping circuits 102 and 103 output logical values "1", respectively. When the detector 13 detects the slit 11, a set signal is applied to a flip-flop 110, and a bank direction signal i becomes a logical value "1". When the detector 14 detects the slit 11, a reset signal is applied to the flip-flop 110, and the bank direction signal i becomes a logical value "0".

The bank direction signal i is used as a control signal for the printer; however, further description of the signal i will be omitted, because it is not concerned with the invention.

When the detector 12 detects the slit 10, the waveform shaping circuit 101 outputs a slit signal f of "1". When no slit 10 is detected, the slit signal f is maintained at "0". The slit signal f is applied to an input terminal of a memory 106.

The addresses in the memory 106 are controlled as follows:

The content of an address controlling counter 104 for the memory 106 is increased by one (+1) at periods $t_0$ with a clock signal CLK1 a; that is, the output of the counter 104, namely, a memory address e is increased by +1 every time period $t_0$. A counter clear signal d from a counter period circuit 105 is applied to the clear input terminal (CLR) of the counter 104. When a counter signal d of a logical value "0" is produced, the counter 104 is reset (cleared) and the memory address e becomes zero. Thereafter, whenever the clock signal CLK1 a is outputted, the content of the counter 104 will be increased by +1 and the memory address e will be changed, thus specifying the addresses of the memory 106 from the 0-th address. If the periodicity of the counter clear signal d is represented by T and the maximum value of the memory address e output of the counter 104 is represented by N, then the following relation holds:

$$T \cong t_0 \cdot (N+1)$$

The period T of the counter clear signal d can be varied as desired. If, for example, the period of the counter clear signal d is set to $T'(<T)$, then the maximum value of the memory address e becomes $N'(<N)$. In this case, $T' \cong t_0(N'+1)$.

That is, the range of addressable addresses in the memory 106 may be changed by changing the period of the counter clear signal d; the range of addresses being repeatedly and cyclically specified.

Thus, data written in an address of the memory 106 is read out the next time this address is specified, e.g. after one period T of the counter clear signal d; that is, the data can be outputted with a variable delay time T or T', as desired.

The invention will now be described in more detail.

When the cam of the cam device 3 makes one revolution, the hammer bank 2 accomplishes one reciprocation. Each print hammer 1 has 48 dot print positions. The slits 10 corresponding to these print positions will be designated by reference characters S1, S2, . . . and S48, respectively. The slits 10 are provided at equal angular intervals of 2.8 degrees. Therefore, after the slit S1 is detected with the encoder disc 5 being rotated a slit 10 is detected every 2.8 degrees. That is, the slits S1 through S48 are detected successively at angular intervals of 2.8 degrees.

When the slit S1 is detected by the detector 12, the slit (10) signal f becomes "1". In this case, it is assumed that the memory address e of the memory 106 is $K_1$. A write pulse (WRT PULSE) b (FIG. 4) is outputted to the memory 106, and the slit signal f at "1" is written in the address $K_1$ of the memory 106. Thereafter, when the clock signal CLK1 a is produced, the content of the counter 104 is increased by +1, and the memory address e becomes $(K_1+1)$.

Thereafter, for a period which elapses until the slit S1 passes, the slit signal f is maintained at "1", and therefore the logical value "1" is written in subsequent addresses in the memory 106.

It is assumed that, when the slit S1 has passed, the memory address e is $K'_1$. For the time interval which elapses from the time that the slit S1 has passed to the time that the next slit S2 is detected by the detector 12, the slit signal f is maintained at "0", and therefore the logical value "0" is written in the addresses in the memory 106.

When the slit S2 is detected by the detector 12, the slit signal f becomes "1" again. It is assumed that, in this case, the memory address e of the memory 106 is $K_2$ (where $K_1<K_2$). The write pulse (WRT PULSE) b is produced, so that the slit signal f of logical value "1" is written in address $K_2$ in the memory 106. Thereafter, when the clock signal CLK1 a is outputted, the content of the counter 104 is increased by +1, and the memory address e becomes address $(K_2+1)$.

Thereafter, the content of the counter 104 is increased by +1 whenever the clock pulse CLK1 a is provided as was described above, and the logical value of the slit signal f at that time is written in the memory 106 with the write pulse (WRT PULSE) b.

The content of the counter 104 is increased as described above. When the memory address e reaches (N+1) after N, the counter clear signal d (FIG. 4B) is outputted to clear the content of the counter 104, and therefore the memory address e becomes 0.

In succession, the same operation as above is repeated, and the memory address e reaches $K_1$. The memory 106 outputs a memory output signal g which in this case is the logical value "1" of the slit signal f which was written upon the previous detection of the slit S1. The signal is applied to an input terminal D of a flip-flop 107, thus becoming a slit delay signal h of the flip-flop 107.

Therefore, for the period in which the memory address e is cycled from $K_1$ to $(K'_1-1)$, the memory output signal g is at "1" and the output of the flip-flop 107, i.e. the slit delay signal h, is also at "1".

During the period in which the memory address e is cycled from $K'_1$ to $(K_2-1)$, the slit S1 has passed, and the next slit S2 is not yet detected. Therefore, for this period, the memory output signal g is at "0", and the slit delay signal h is also at "0".

As is apparent from the above description, the slit signal f detected by the detector 12 is outputted as a slit delay signal h with a delay time of $t_0 \times (N+1)$ where $t_0$ is the period of the clock signal CLK1 a and (N+1) is the number of addresses covered by the memory address counter 14 during the period between counter clear signals. The delay time can be changed by changing the value N. Therefore, the delay time can be set as desired.

Thus, if the drive time instant of the print hammer 1 is set using the slit delay signal h, the print hammer 1 can be driven at a desired time instant. That is, adjustment can be readily achieved so that printing is effected at correct print positions.

Figure 5:
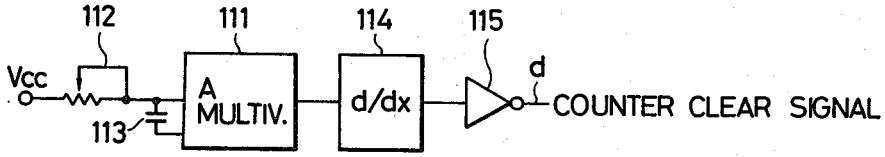
FIG. 5 is a block diagram showing one example of the counter clear circuit of FIG. 3.
Figure 2:
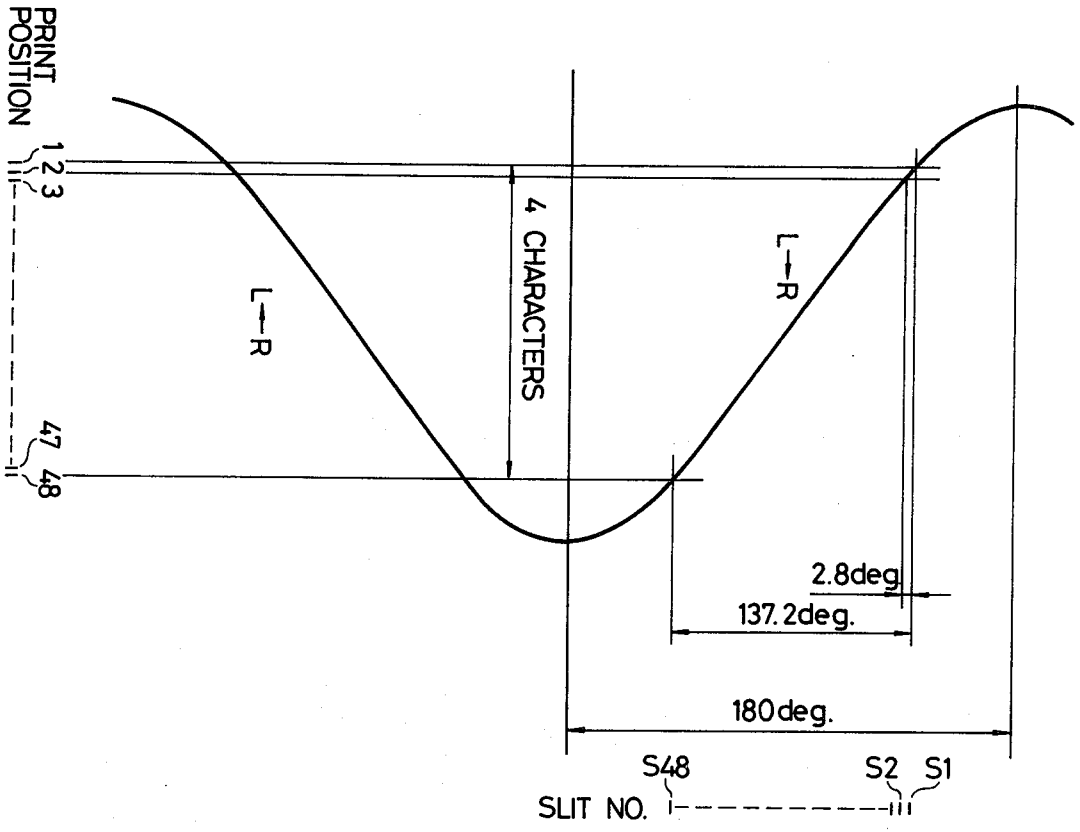
FIG. 2 is a diagram showing the locus of motion of a hammer bank in the printer of FIG. 1.
Figure 3:
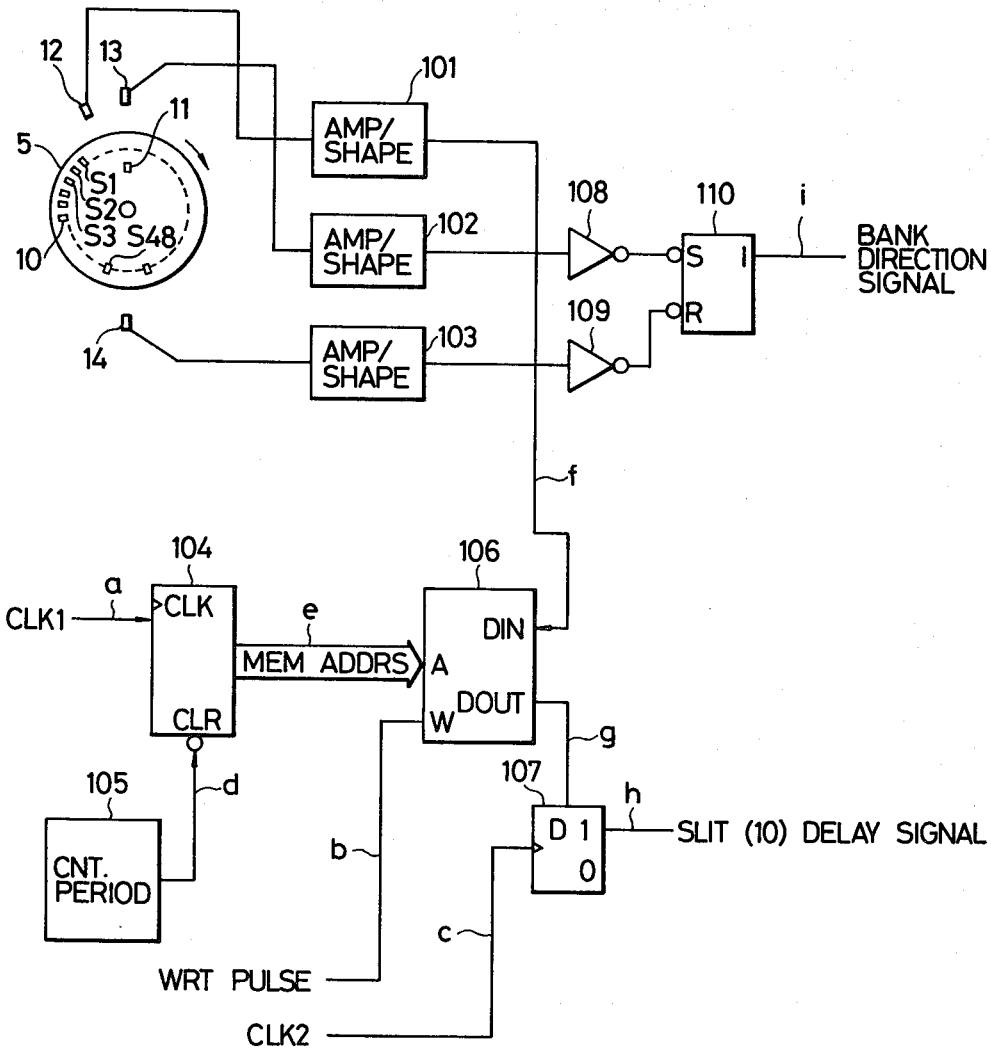
FIG. 3 is a block diagram showing one embodiment of this invention.
Figure 4A:
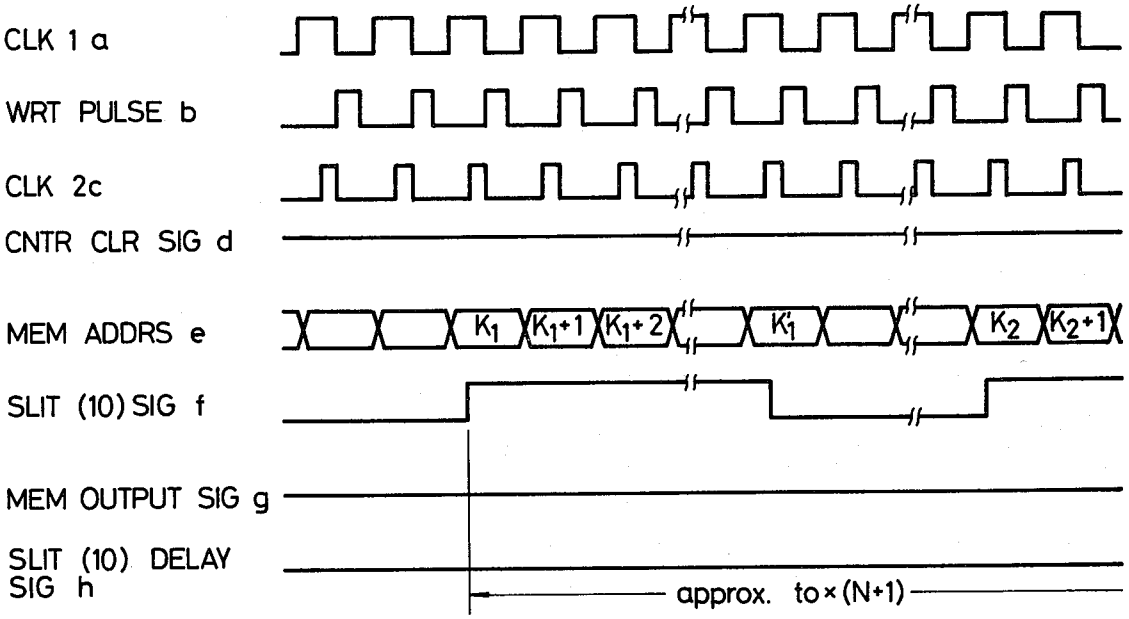
FIGS. 4A and 4B together constitute one timing chart for describing the operation of the circuitry of FIG. 3.
Figure 4B:
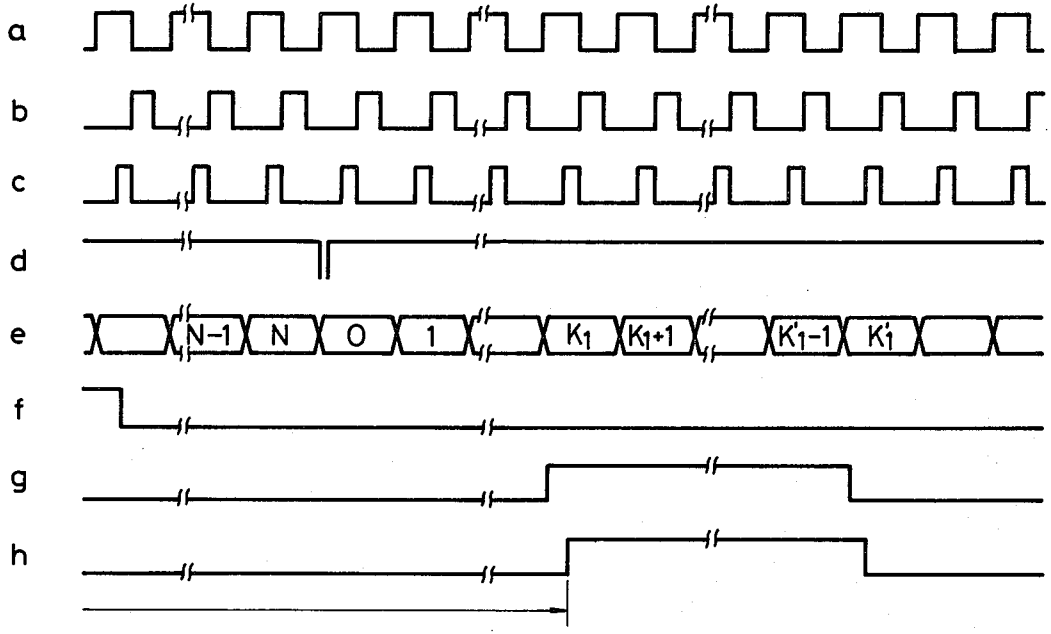

FIG. 5 shows one example of the above-described counter period circuit 105. The circuit 105 is made up of an astable multivibrator 111 having a variable resistor 112 and a capacitor 113 which are externally installed, a differentiation circuit 114 connected to the output terminal of the vibrator 111, and an invertor 115. The period at which the counter clear signal d is generated, namely, the aforementioned value T (or T') can be controlled by changing the resistance of the variable resistor 112.

Therefore, if the resistance of the variable resistor 112 is adjusted by referring to a print sample, then adjustment can be achieved so that printing is effected at correct print positions.

The embodiment of the invention has been described with reference to a dot line printer in which print hammers having dot elements are reciprocated in the direction of a line; however, it will be understood that the technical concept of the invention is applicable to ordinary line printers having type carriers, and to serial type printers in which printing is effected by reciprocating at least one printing head in the direction of a line.

Heretofore, printer adjustment has been carried out by operating the mechanism section, thus taking a relatively long time. However, adjustment can be electrically achieved with ease according to the invention, which contributes greatly to a reduction in the number of adjustment steps and to a decrease of the manufacturing cost of the device.

What is claimed is:

1. A timing control method for a reciprocating print head, comprising the steps of:

sensing a position of said print head and producing a position signal having a first state for periodic predetermined positions of said print head corresponding to printing positions and a second state for other positions of said print head;

periodically storing values of said position signal in an addressable memory; and reading out said stored values a selected time period after storing said values, said selected time period being at least as great as the time interval during which said position signal periodically assumes said first state.

2. The timing control method of claim 1, further comprising the step of varying said selected time period in accordance with a flight time of hammers of said print head from a rest position to a printing position.

3. The timing control method of claim 1, wherein said steps of storing and reading out said stored values each comprise producing a sequential count for addressing a memory in which said values are stored.

4. The timing control method of claim 3, further comprising the step of resetting said count to a start count value periodically at a period determined by said selected time period.

5. The timing control method of claim 1, wherein, in said step of storing values of said position signal, values of said position signal are stored at an interval significantly less than a duration of said position signal in said first state.

6. A timing control device for a printer of the type employing a print head, comprising:

signal generating means for producing a position signal having a first state for positions of said print head corresponding to printing positions and a second state for other positions of said print head;

addressable memory means for periodically storing values of said position signal;

counter means for sequentially generating an address signal for said memory means;

counter period setting means for generating a signal resetting said counter means at a selectable timing, whereby the position signal values stored in said memory means may be read-out of said memory means a selectable time after being stored therein, and means for outputting said read-out values as a timing signal.

* * * * *